US006305117B1

(12) United States Patent
Hales, Sr.

(10) Patent No.: US 6,305,117 B1
(45) Date of Patent: Oct. 23, 2001

(54) SUPPORT FOR RIFLE SIGHTING

(76) Inventor: Lawrence R. Hales, Sr., 1473 Bel Fire Tower Rd., Reeves, LA (US) 70658

( * ) Notice: Subject to any disclaimer, the term of this patent is extended or adjusted under 35 U.S.C. 154(b) by 0 days.

(21) Appl. No.: 09/447,796

(22) Filed: Nov. 23, 1999

Related U.S. Application Data

(60) Provisional application No. 60/109,738, filed on Nov. 24, 1998.

(51) Int. Cl.[7] ..... F41A 23/14

(52) U.S. Cl. ..... 42/94; 89/37.04

(58) Field of Search ..... 42/90, 94; 89/37.01, 89/37.04; 43/21.2; 211/64; 248/528, 615, 188.2, 188.5, 188.6, 118, 125.8; D22/108; 482/104

(56) References Cited

U.S. PATENT DOCUMENTS

| | | | | |
|---|---|---|---|---|
| D. 203,680 | * | 2/1966 | Allison | D22/108 |
| D. 387,123 | | 12/1997 | Hughes et al. | D22/199 |
| D. 390,301 | | 2/1998 | Peterson | D22/108 |
| D. 391,616 | | 3/1998 | Plybon | D22/108 |
| 4,026,057 | | 5/1977 | Cady | 42/94 |
| 4,411,425 | * | 10/1983 | Milnar | 482/104 |
| 4,854,066 | | 8/1989 | Canterbury, Sr. | 42/94 |
| 4,967,497 | * | 11/1990 | Yakscoe | 42/94 |
| 5,070,636 | | 12/1991 | Mueller | 42/94 |
| 5,078,309 | * | 1/1992 | Hull et al. | 224/42.45 R |
| 5,081,783 | | 1/1992 | Jarvis | 42/94 |
| 5,345,706 | | 9/1994 | Brown | 42/94 |
| 5,414,949 | | 5/1995 | Peebles | 42/94 |
| 5,423,502 | * | 6/1995 | Thomason et al. . | |
| 5,497,575 | | 3/1996 | Fried | 42/94 |
| 5,628,135 | * | 5/1997 | Cady | 42/94 |
| 5,778,589 | * | 7/1998 | Teague | 42/94 |
| 5,913,668 | * | 6/1999 | Messer | 42/94 |
| 5,924,964 | * | 7/1999 | Hayden | 482/104 |

FOREIGN PATENT DOCUMENTS

| | | | | |
|---|---|---|---|---|
| 674569 | * | 6/1990 | (CN) | 42/94 |
| 3319 | * | 2/1907 | (GB) | 42/94 |

* cited by examiner

*Primary Examiner*—Michael J. Carone
*Assistant Examiner*—Son T. Nguyen
(74) *Attorney, Agent, or Firm*—Richard C. Litman

(57) ABSTRACT

A configurable device for supporting, sighting and firing both shouldered and hand-held firearms. The device includes a tripod base having front and rear extensible vertical supports. The extensible supports are provided with substantially U-shaped cradle elements for holding a firearm. The extensible supports are pivotally mounted in brackets attached to the base permitting folding thereof. The extensible supports allow a wide range of vertical adjustment for sighting and firing from various positions, such as sitting, kneeling and standing positions. The rear support is slidably mounted to the base thereby providing adjustment mechanism for accommodating various lengths of shouldered firearms as well as hand-held firearms. The device can be folded for convenient storage and transport and is used just as easily in the field or on a shooting bench.

7 Claims, 8 Drawing Sheets

SUPPORT FOR RIFLE SIGHTING

CROSS-REFERENCE TO RELATED APPLICATION

This application claims the benefit of U.S. Provisional Patent Application Ser. No. 60/109,738, filed Nov. 24, 1998.

BACKGROUND OF THE INVENTION

1. Field of the Invention

The present invention relates to a firearm support for sighting and firing shouldered and hand-held firearms. More specifically, the present invention is directed to an improved, collapsible, tripod-type firearm support adapted for field or bench use which allows the user to sight and fire a firearm from various shooting positions.

2. Description of Related Art

Firearm supports date to the beginning of firearms. Early sighting devices comprised a single pole which was used to stabilize the barrel end of a musket. The pole provided minimal stability, but enabled a shooter to more effectively sight and shoot at a target from long distances while in an upright or standing position. Modern derivatives of the pole-type support include telescoping pole-type supports which are adjustable in height; these devices allow a shooter to sight and fire a weapon from various positions, such as standing or kneeling positions.

Firearm sighting devices having a tripod-type support have been utilized for bench and field use. Tripod supports which engage and support a firearm at two points of contact, namely the barrel and butt ends of a firearm, are common. Tripod-type devices provide stability and allow fine elevational adjustment while sighting a firearm. Known tripod sighting devices are typically placed on the ground, or on a shooting bench; however, they do not provide a wide range of vertical adjustment to facilitate a wide range of sighting and firing positions.

Tripod sighting devices configurable for use with both hand-held and shouldered firearms have also been used. Typically, a sighting device of this type has horizontally movable firearm supporting elements to accommodate a shorter length handgun, but does not provide a range of vertical adjustment to accommodate a standing user, particularly if the device is supported on the ground.

U.S. Pat. Nos. 4,026,057, 5,070,636, 5,081,783, 5,497,575, 5,628,135, U.S. Des. Pat. Nos. 203,680, and 387,123 illustrate prior art tripod-type sighting devices. These tripod-type sighting devices include height adjustment mechanisms for finite vertical adjustment only. Furthermore, some are configurable for use with shouldered and hand-held firearms; however, these patents do not show a tripod-type sighting device which allows a substantial height adjustment to facilitate sighting and firing a firearm from sitting and standing positions.

U.S. Pat. No. 5,345,706 and U.S. Des. Pat. No. 390,301 illustrate firearm supports of the telescoping pole-type; whereas these devices facilitate sighting from various positions, they do not have the stability of a tripod.

U.S. Pat. No. 4,854,066 and U.S. Des. Pat. No. 391,616 disclose rifle rests having a single telescoping support including a firearm cradle which engages a rifle at the barrel and butt ends of a rifle. Again, these devices do not provide the stability of a tripod support.

U.S. Pat. No. 5,414,949 discloses a portable shooting stand having an extensible firearm support; however, only one extensible support is provided and that engages the barrel end only. Finite adjustment is facilitated by moving the free or butt end of the rifle. Also, the device is bulky and not suitable for field use.

None of the above inventions and patents, taken either singly or in combination, is seen to describe the instant invention as claimed.

SUMMARY OF THE INVENTION

The present invention is a firearm sighting device for supporting, sighting, and firing both shouldered and hand-held firearms. The firearm sighter is a configurable support having a tripod base and front and rear extensible vertical supports. The extensible supports each include a substantially U-shaped cradle element adapted to engage and support a firearm. The base comprises a generally rectangular beam having front and rear brackets attached thereto. The front bracket is fixedly attached to the forward end of the base and supports foldable legs. The rear bracket is slidable along the base and includes a foot portion. The front legs and rear foot form a tripod support.

In the preferred embodiment, the front and rear extensible supports are nearly identical in structure and are pivotally mounted in the corresponding front and rear brackets. The extensible supports each comprise an outer support element, an inner support element, a threaded rod portion, a thumbwheel, and a substantially U-shaped firearm cradle element. The inner support is slidable within the outer support thereby facilitating a wide range of vertical adjustment. A set screw passes through a threaded aperture at the upper end of each outer support element; turning the set screw urges it toward the inner support, thereby frictionally locking the inner support at a desired height. The inner support houses a thumbwheel and threaded rod. Turning the thumbwheel urges the threaded rod up or down relative to the inner support allowing fine vertical adjustment. A substantially U-shaped firearm support cradle is mounted to the top end of each threaded rod by a screw. A removable foam pad may be placed inside each cradle to cushion a firearm supported by the cradles.

The front and rear brackets allow movement of the extensible supports from a folded position, parallel to the base, to an upright position, perpendicular to the base. Each bracket includes tab portions for limiting travel of the extensible supports past the upright position. Indents on each side of the brackets cooperate with detents in the sides of the front and rear outer support elements. The cooperating indents and detents engage and lock the extensible supports in the upright position. The brackets are arranged facing each other such that the extensible supports can fold inwardly. The front and rear extensible supports are each held in their corresponding bracket via a pin inserted through cooperating apertures in the sides of the brackets and at the sides at the bottom end of each outer support element. The front and rear bracket connecting pin apertures are located at different heights on the front and rear brackets to allow folding of the extensible supports. Folding may be accomplished with the rear bracket located at the rearmost position thereby permitting the fully collapsed front extensible support and cradle element to clear the rear bracket. The fully collapsed rear extensible support can then be folded with the rear cradle clearing the front bracket.

Accordingly, it is a principal object of the invention to provide an improved tripod-type firearm sighting device configurable for sighting and firing shouldered and hand-held firearms from various positions including sitting, kneeling, and standing positions.

It is another object of the invention to provide a sighting device which may be used on a bench support or in the field.

It is a further object of the invention to provide a sighting device which can be collapsed easily for convenient transport.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
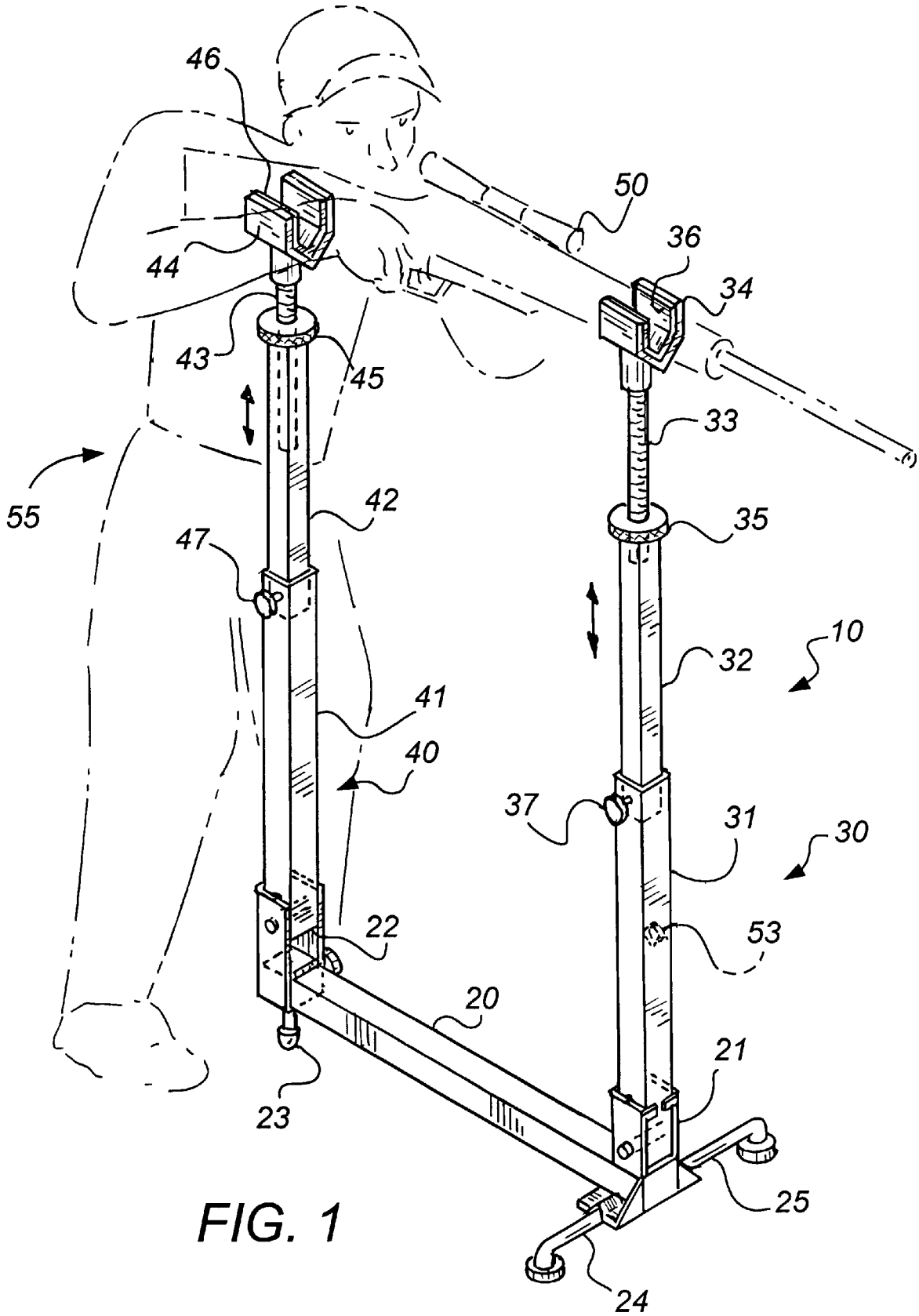
FIG. 1 is an environmental, perspective view of the firearm sighter configured for a standing shooter and supporting a shouldered firearm.
Figure 3:
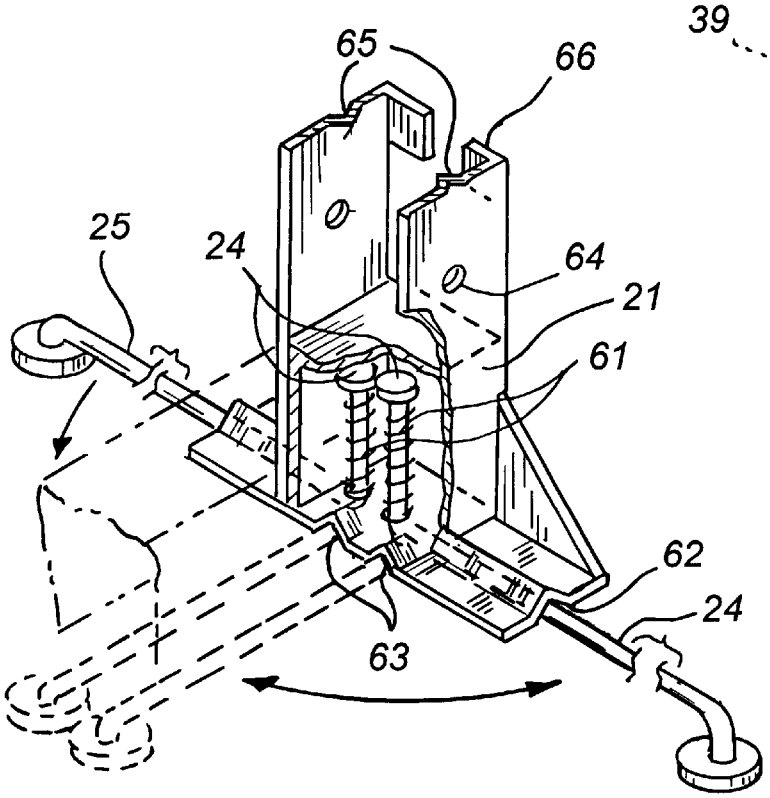
FIG. 3 is a fragmented, perspective cut-away view of the forward end of the firearm sighter showing details of the front bracket leg locking mechanism.

Referring to FIG. 1, the firearm sighting device 10 according to the present invention generally includes a base 20, a vertically extensible front support 30, and a vertically extensible rear support 40, for supporting, sighting and firing a firearm 50. The front and rear vertically extensible supports 30, 40 are pivotally mounted on corresponding front and rear brackets 21, 22. The front bracket 21 is attached at the forward end of base 20. Front legs 24 and 25 are pivotally attached to the front bracket 21. Rear bracket 22 is slidable along base 20. Foot 23 has a threaded portion which screws into an aperture at the bottom of rear bracket 22. Legs 24 and 25 and foot 23 form a tripod support for base 20. Foot 23 functions also as a set screw for frictionally retaining rear bracket 22 to base 20. Front bracket 21 may be formed separately from and fixedly attached to base 20. Alternatively, the front bracket 21 and base 20 may be formed as a single component.

Vertically extensible supports 30, 40 are nearly identical in structure and are each formed with three extensible sections. Both front and rear extensible supports hold a U-shaped firearm cradle element 34, 44 for supporting a firearm 50. Preferably, the front extensible support 30 comprises an outer support member 31 and an inner 32 support member slidably disposed within the outer support member 31. Set screw 37 passes through an aperture in the upper end of the outer support and locks the inner and outer supports at a desired height.

Figure 2:
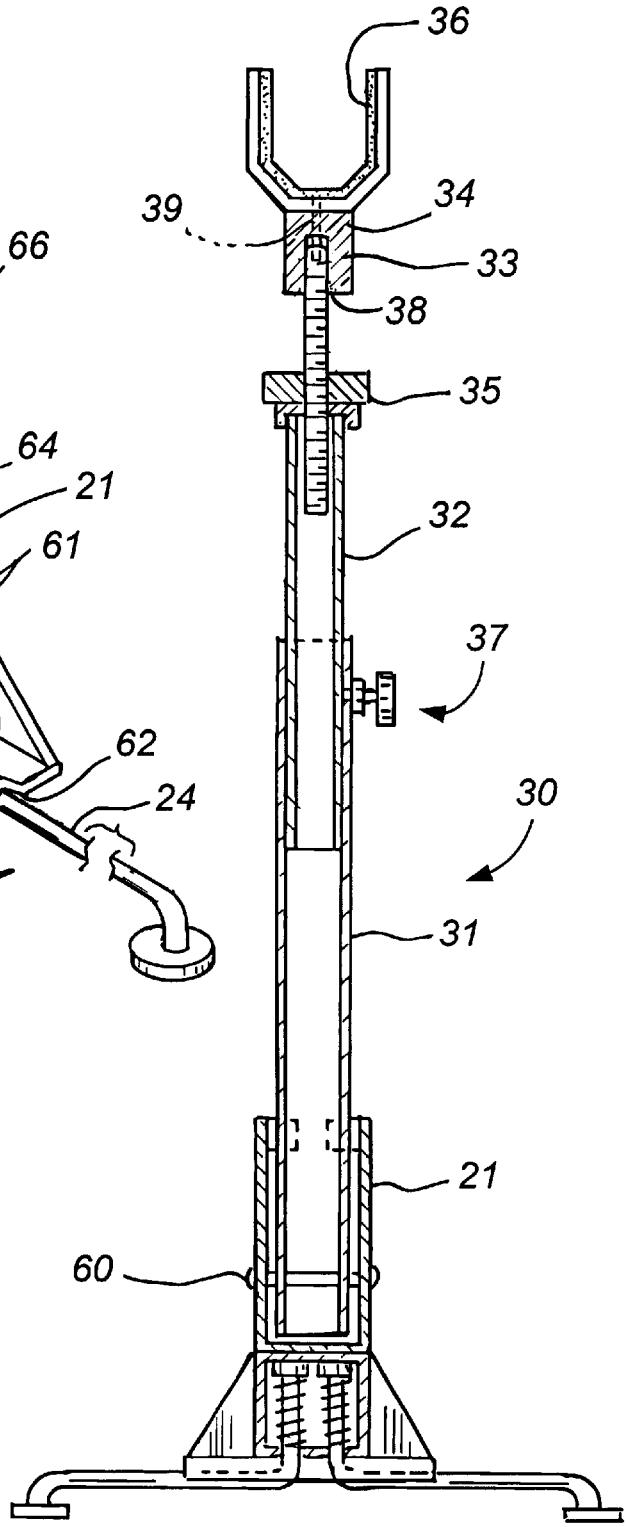
FIG. 2 is an elevational cross-sectional view of the forward end of the firearm sighter.
Figure 5:
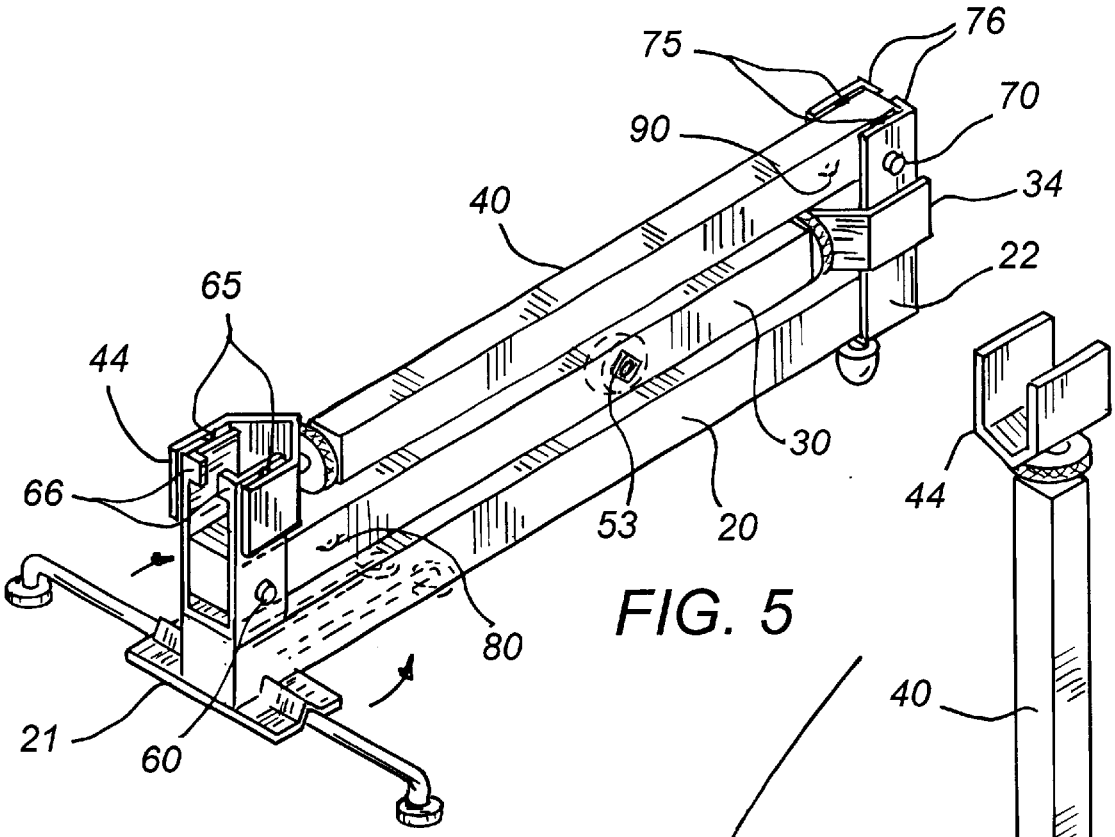
FIG. 5 is a perspective view of the firearm sighter collapsed for transport.
Figure 4:
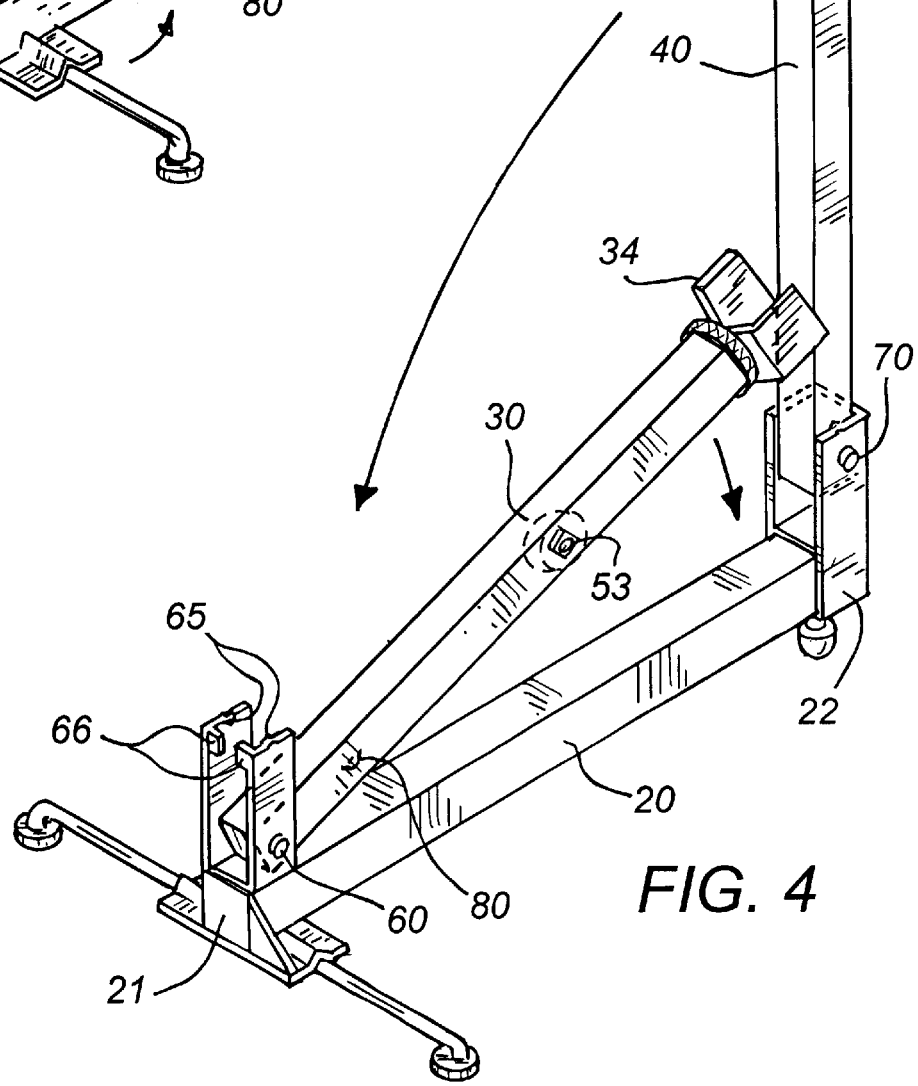
FIG. 4 is a perspective view of the firearm sighter partially folded.

With reference to FIG. 2, threaded rod 38 is extensible from the inner support 32 by means of a thumbwheel 35. Cradle base 33 is threaded onto to the top portion of the threaded rod 38. A screw 39 pivotally secures padded cradle 36 to base 33, and a line of separation between cradle 36 and base 33 is clearly seen in FIG. 2. The foam pad in cradle 36 fits the contour of the cradle and functions to cushion the points of contact between a firearm and the cradle 36.

Referring to FIGS. 2, 3, 4 and 5, the front extensible support 30 is pivotally mounted in front bracket 21. The front bracket includes apertures 64 for receiving a pivot pin 60 which passes through cooperating apertures at the bottom of outer support 31. Tabs 66 on the front bracket restrict movement past 90 degrees. Indents 65 cooperate with detents 80 formed in the outer support 31 to lock the forward support in an upright position. Front bracket 21 houses front leg assemblies comprising front legs 24, 25 and coil springs 61. Legs 24, 25 are generally L-shaped having the "L" portion passing through apertures at the bottom of the front bracket. The ends of the "L" portion are enlarged to retain the coil springs 61 under tension. The front bracket includes detents 62, 63 which cooperate with the legs; the detents 62, 63 form distinct channels for receiving the legs. Legs 24 and 25 can pivot between detents 62, 63, much in the manner of a bicycle kickstand. The mechanism permits the legs to be moved from a deployed position at detents 62 to a folded position at detents 63.

The rear extensible support 40 is nearly identical to the front extensible support and includes outer support element 41, inner support element 42, threaded rod 43, cradle 44, thumbwheel 45, foam pad 46, and set screw 47. A difference between the front and rear extensible supports is the location of the detent portions 80, 90. The rear extensible support is mounted in rear bracket 22 via pivot pin 70. The rear support mounting position is higher in the rear bracket relative to the front extensible support to facilitate folding thereof. The rear bracket 22 also includes detents 75 and tabs 76 similar to the front bracket. The front and rear brackets are oriented such that the extensible supports can fold inwardly.

Figure 6:
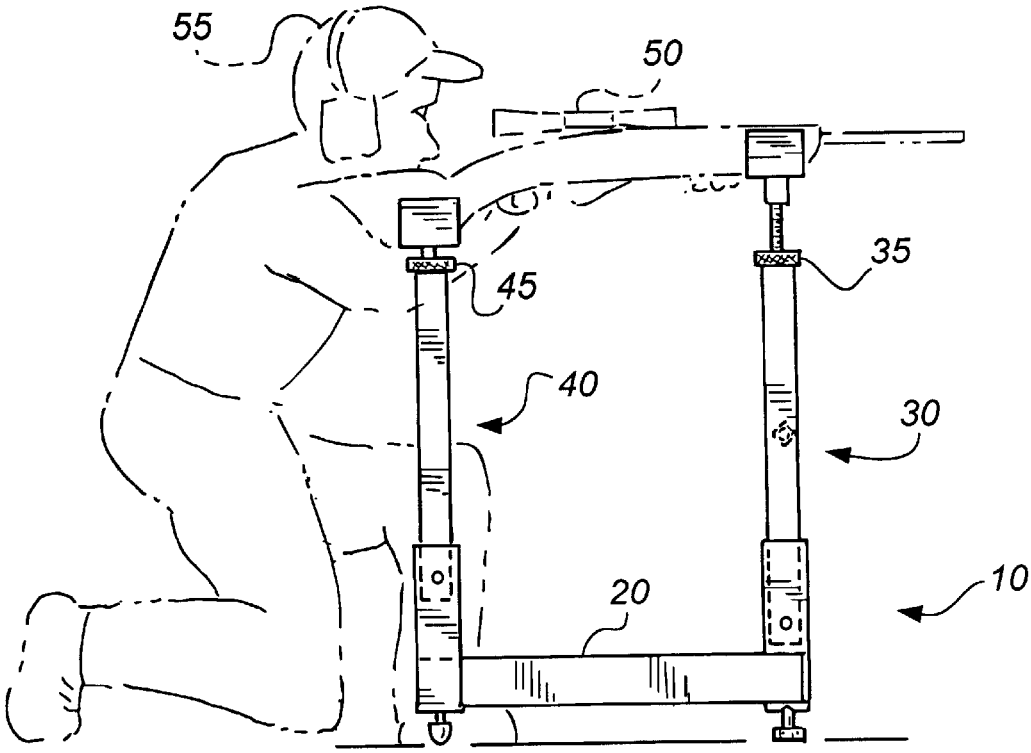
FIG. 6 is a side elevational view of the firearm sighter configured for sighting a rifle with a shooter in a kneeling position.

As illustrated in FIG. 6, the firearm sighter 10 can be configured for use by a shooter 55 in a sitting or kneeling position. The device can be placed on the ground with the extensible supports 30, 40 in the retracted position while using the thumbwheels 35, 45 to provide fine elevational adjustment. FIG. 6 shows the device configured for a shouldered firearm 50 with the shooter 55 in a kneeling or sitting position.

Figure 7:
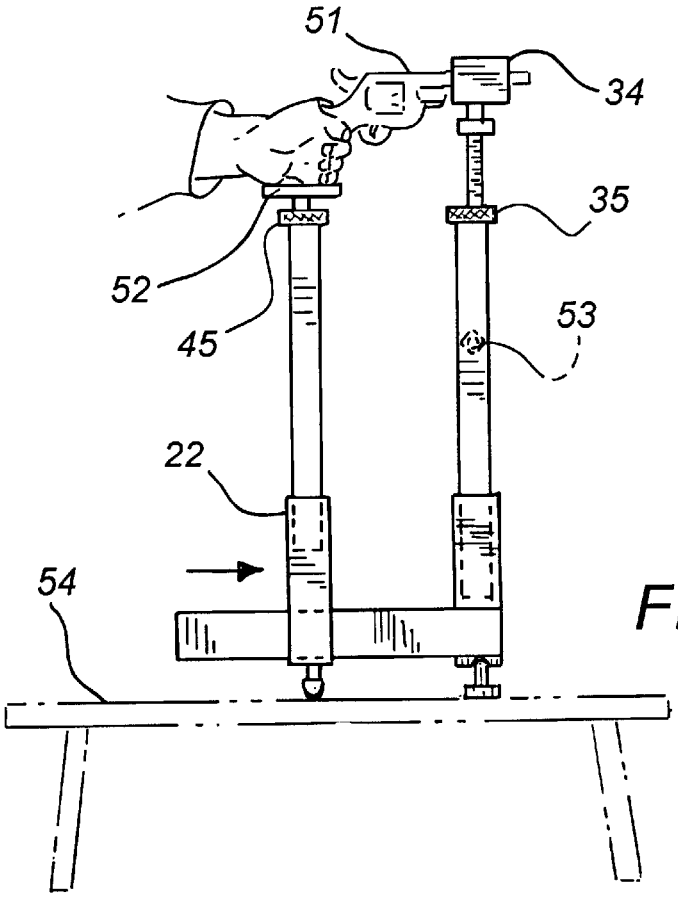
FIG. 7 is a side elevational view showing the firearm sighter on a benchtop and configured for use with a pistol.

Referring to FIG. 7, the firearm sighter is configured for use with a hand-held firearm 51 on a shooting bench 54. Rear bracket 22 is moved forward to accommodate a pistol with the barrel supported by front cradle 34. An alternate support 52 for use with a pistol can be mounted in place of the U-shaped cradle. The support 52 has a generally flat surface for resting the handgrip and/or the hand of the shooter.

The support 52 includes a threaded stub shaft therebeneath, clearly seen in FIG. 7, which is threaded into thumbwheel 45. When not in use, the support 52 is removed from its FIG. 7 position and stored, conveniently, by being attached to a nut 53, welded to the side of support 31, which provides a non-use storage means for support 52. The threaded stub shaft beneath support 52 is threaded onto nut 53, thereby attaching support 52. The stowed or storage position is seen in dash-line in FIGS. 4 and 5.

Figure 8:
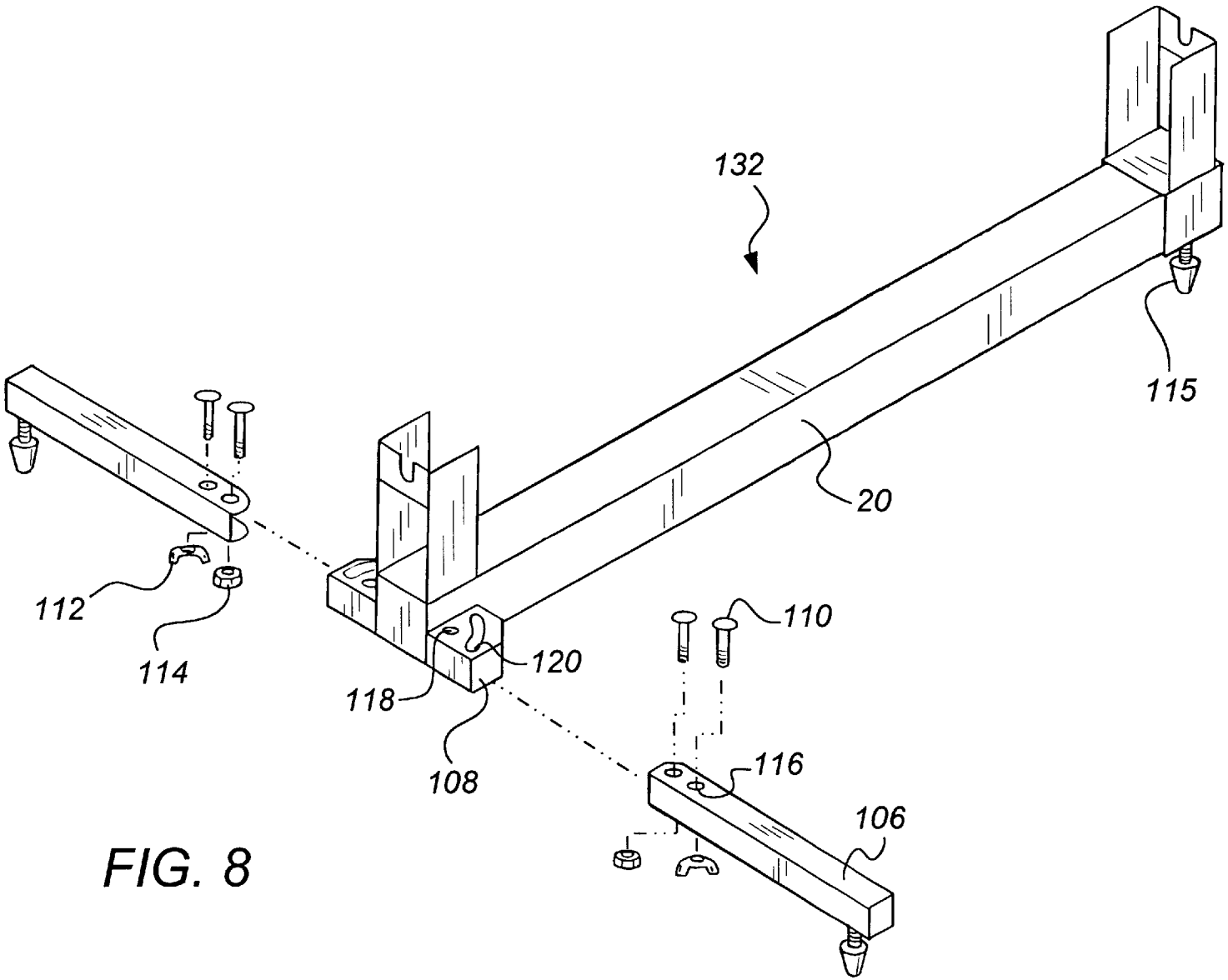
FIG. 8 is a close-up, perspective view of an alternate embodiment showing the leg portion of a firearm sighter with folding legs.

FIG. 8 is a close-up, perspective view of an alternate embodiment showing the leg portion 132 of a firearm sighter 130 with folding legs 106. The legs 106 insert into a slot 108 on the base 20 and the legs 106 are secured to the base 20 using a pair of screws (110*a*, 110*b*) and a pair of nuts (112, 114). One screw 110*b* is inserted into a standard circular hole 118 while the other screw 110*a* is inserted into an elongated, oblong shaped opening 120 that allows the leg 106 to be rotated 90 degrees. The screw 110*b* in the standard circular hole 118 is secured using a standard shaped nut 114 while the screw 110*a* in the oblong shaped hole 120 is secured using an winged nut 114 which allows easy tightening and loosening of the screw 110*a*. The threaded foot 115 of this embodiment has a conical shape as depicted in FIG. 8.

Figure 9:
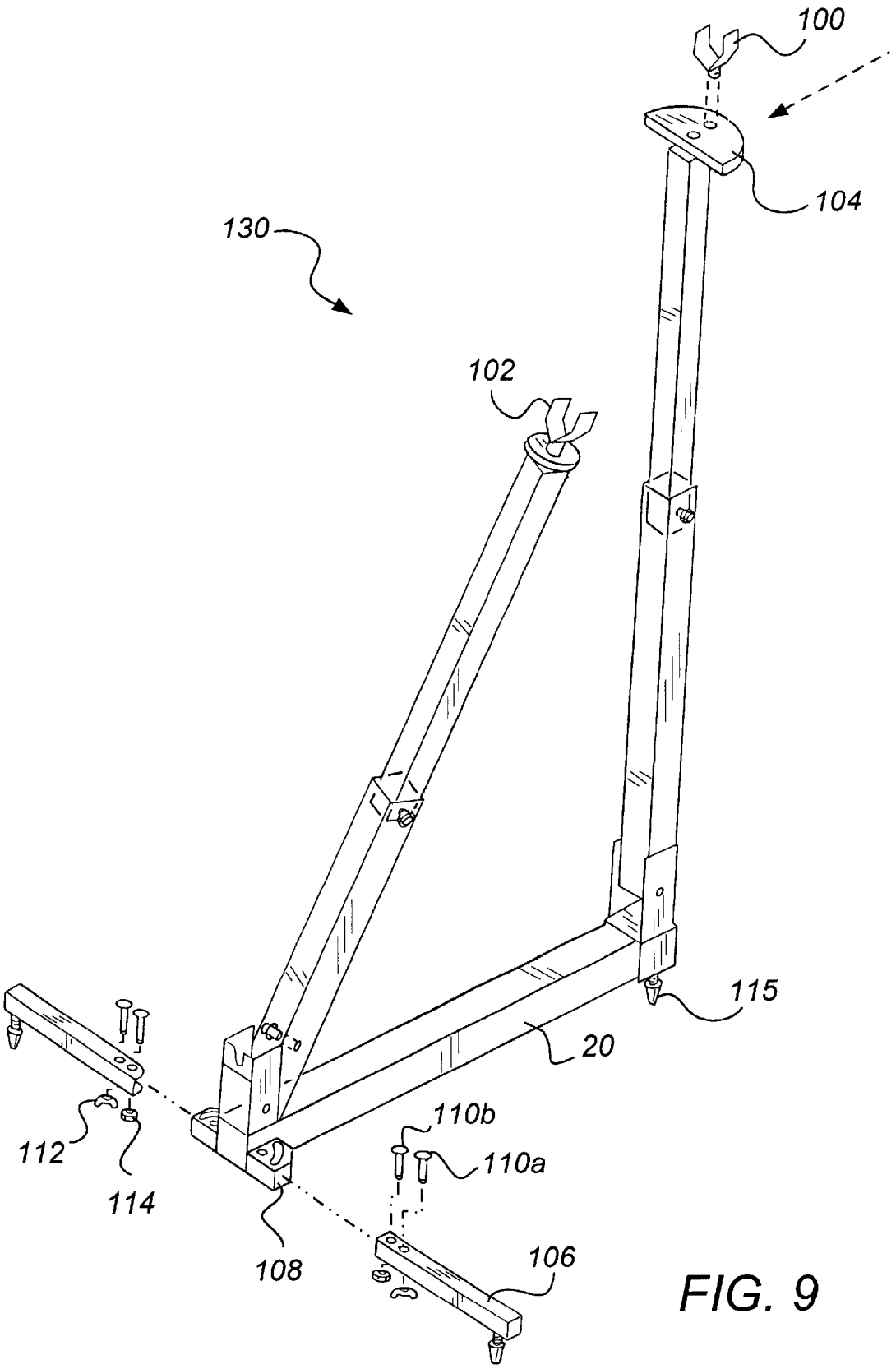
FIG. 9 is a partially exploded perspective view of a firearm sighter with folding legs.
Figure 10:
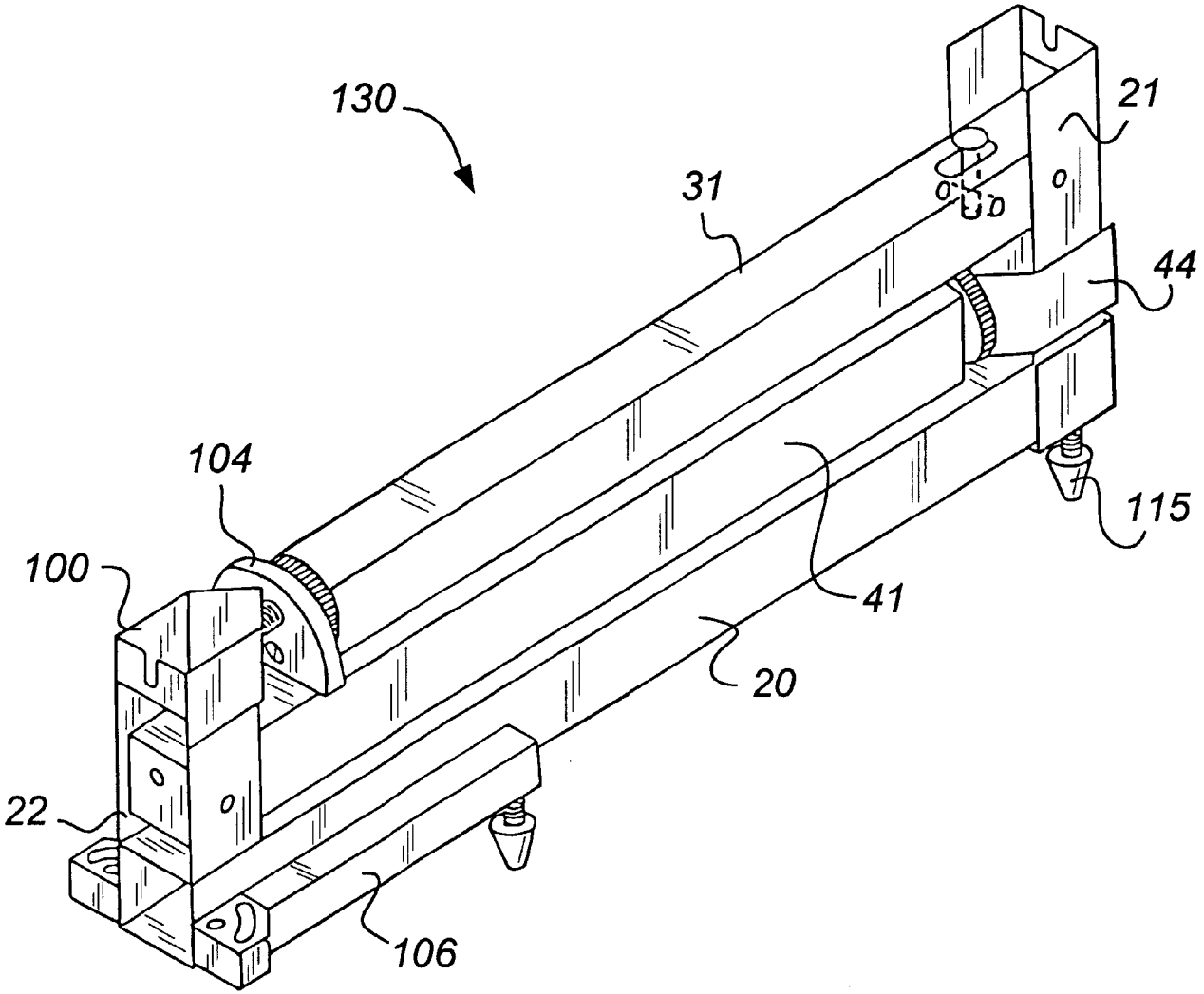
FIG. 10 is a perspective view of a firearm sighter with folding legs collapsed for transport.
Figure 11:
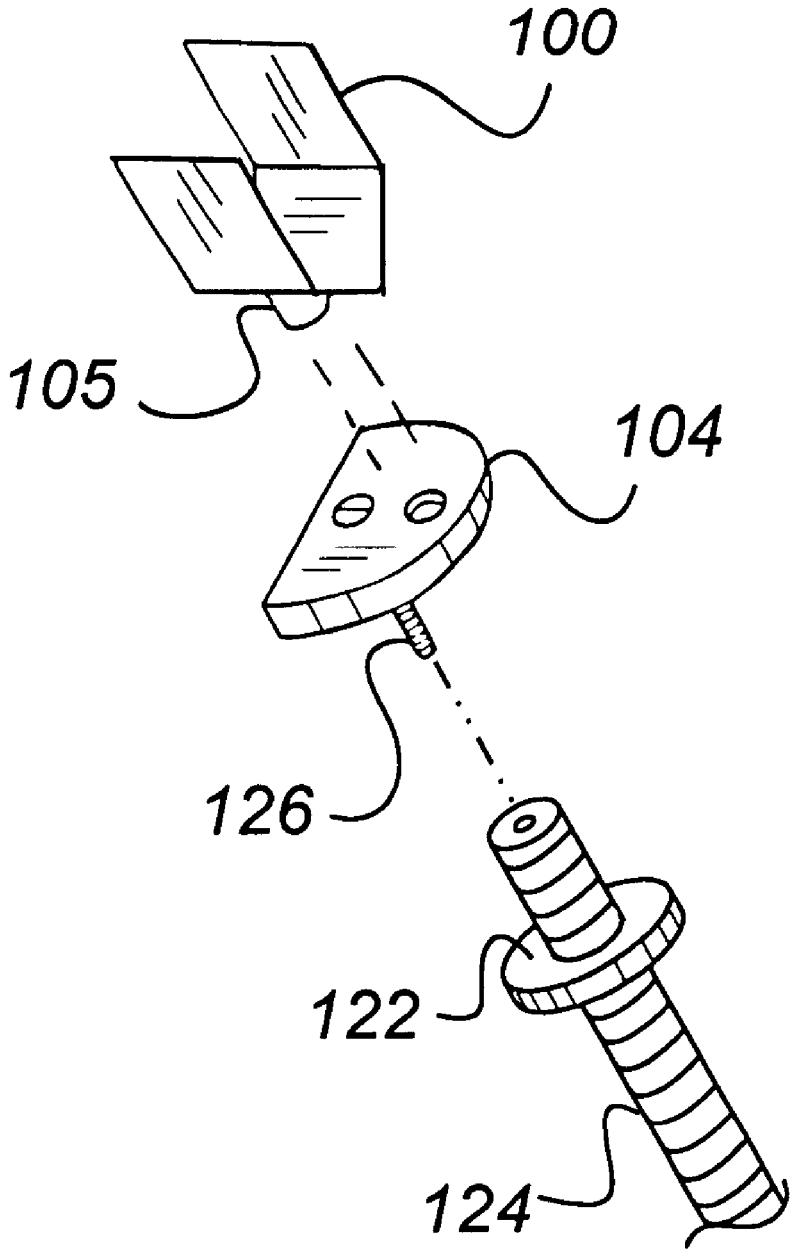
FIG. 11 is a fragmented, exploded, perspective view of the anterior cradle of an alternative embodiment of the firearm sighting device.

FIG. 9 is a perspective view of a firearm sighter 130 with folding legs 106. The distal U-shaped firearm cradle element 100 of the U-shaped firearm cradle elements 100, 102 for supporting a firearm 50 is not directly connected to the thumbwheel 35 in this embodiment. As shown in FIG. 11, the distal or anterior firearm cradle element 100 is mounted onto an intervening mounting element 104. The bottom portion 105 of the anterior firearm cradle element 100 is inserted into a circular opening in the mounting element 104. The mounting element 104 is secured to the shaft 124 of the thumbwheel 122 by means of a screw 126. FIG. 10 shows a perspective view of a firearm sighter 130 with the folding legs 106 collapsed for transport of the firearm sighter 130.

The firearm sighter of the present invention provides the gun enthusiast with an easy and convenient way to practice and improve his or her firearm skills. The firearm sighter of the present invention is easy to setup and easy to take down for storage and transport. The unique and innovative design of the firearm sighter makes it almost effortless to setup, to adjust, to take down, and to transport. Therefore, the firearm hobbyist can spend his or her time enjoying the firearm practice or competition instead of wasting time and effort setting up and adjusting a prior art gun sighting device.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiment described above, but encompasses any and all embodiments within the scope of the following claims.

I claim:

1. A firearm supporting, sighting and firing device comprising:

a) an elongated base having a front end and a rear end;

b) a front bracket fixedly attached to the front end of said base;

c) a rear bracket slidably mounted on the rear end of said base;

d) a rear foot depending from said rear bracket;

e) a pair of front legs pivotally attached to said front bracket, said base, said front legs and said rear foot forming a tripod base when said front legs are extended;

f) a telescoping front support having an outer support element pivotally attached to said front bracket and an inner support element slidably disposed in the outer support element;

g) a telescoping rear support having an outer support element pivotally attached to said rear bracket and an inner support element slidably disposed in the outer support element;

h) a front U-shaped firearm cradle rotatably mounted on the inner support element of said front support; and i) a rear U-shaped firearm cradle rotatable mounted on the inner support element of said rear support, said front and rear cradles being adapted to receive a firearm.

2. The device according to claim 1, wherein said telescoping front and rear supports are height adjustable in order to support, sight and fire shouldered and hand-held firearms from sitting, kneeling and standing positions.

3. The device according to claim 1, wherein the rear bracket is slidable along the base in order to provide adjust the distance separating said front cradle from said rear cradle.

4. The device according to claim 1, further comprising a foam cushion disposed in said front cradle.

5. The device according to claim 1, further comprising a foam cushion disposed in said rear cradle.

6. The device according to claim 1, further comprising a height adjustment mechanism for adjusting the height of said front cradle, the mechanism including a screw rotatably disposed in said front support and a thumbwheel fixedly attached to the inner support element of said front support and rotatably disposed about said screw, said front cradle being disposed on said screw, the height being adjusted by rotating said thumbwheel about said screw.

7. The device according to claim 1, further comprising a height adjustment mechanism for adjusting the height of said rear cradle, the mechanism including a screw rotatably disposed in said rear support and a thumbwheel fixedly attached to the inner support element of said rear support and rotatably disposed about said screw, said rear cradle being disposed on said screw, the height being adjusted by rotating said thumbwheel about said screw.

* * * * *